US005921657A

United States Patent [19]

Case

[11] Patent Number: 5,921,657

[45] Date of Patent: Jul. 13, 1999

[54] FLASHLIGHT CARRIER SLEEVE AND HANDLE

[76] Inventor: Richard N. Case, 2525 Arapahoe Rd., Suite E4-277, Boulder, Colo. 80302

[21] Appl. No.: 08/905,752

[22] Filed: Aug. 4, 1997

Related U.S. Application Data

[63] Continuation-in-part of application No. 29/047,152, Nov. 28, 1995, Pat. No. Des. 381,805.

[51] Int. Cl.[6] ..... F21L 7/00

[52] U.S. Cl. ..... 362/191; 362/190; 362/103

[58] Field of Search ..... 362/105, 190, 362/191, 194, 103

[56] References Cited

U.S. PATENT DOCUMENTS

| | | | |
|---|---|---|---|
| D. 252,051 | 6/1979 | Luen . | |
| D. 276,079 | 10/1984 | Cheng . | |
| D. 293,628 | 1/1988 | Teachey . | |
| D. 328,820 | 8/1992 | Davie . | |
| D. 344,411 | 2/1994 | Henry et al. . | |
| 1,408,527 | 3/1922 | Lyhne . | |
| 1,457,023 | 5/1923 | Fergusson | 362/103 |
| 1,769,241 | 7/1930 | Stephani | 362/103 |
| 2,614,206 | 10/1952 | Goad | 362/191 |
| 4,209,116 | 6/1980 | Hendricks . | |
| 4,360,930 | 11/1982 | Blanchard | 362/105 |
| 4,462,064 | 7/1984 | Schweitzer . | |
| 4,718,126 | 1/1988 | Slay | 362/105 |
| 4,797,793 | 1/1989 | Fields | 362/105 |
| 4,970,631 | 11/1990 | Marshall | 362/105 |
| 4,984,724 | 1/1991 | Johnston | 362/108 |
| 5,034,862 | 7/1991 | Liston | 362/191 |
| 5,053,932 | 10/1991 | Case . | |
| 5,154,506 | 10/1992 | Leard | 362/108 |
| 5,180,352 | 1/1993 | Sreter . | |
| 5,188,450 | 2/1993 | Anderson . | |
| 5,217,294 | 6/1993 | Liston | 362/105 |
| 5,325,997 | 7/1994 | Washington et al. . | |
| 5,386,592 | 2/1995 | Checkeroski | 362/105 |
| 5,423,586 | 6/1995 | Fuller . | |
| 5,558,430 | 9/1996 | Booty, Jr. | 362/190 |
| 5,580,157 | 12/1996 | Patricca et al. | 362/191 |
| 5,593,074 | 1/1997 | Matthews | 362/191 |
| 5,601,356 | 2/1997 | McWilliams | 362/191 |

*Primary Examiner*—Laura Tso

*Attorney, Agent, or Firm*—Donald W. Margolis; John L. Isaac; Emery L. Tracy

[57] ABSTRACT

A flashlight carrier sleeve device for carrying a flashlight which has a main body and an illumination end. The sleeve device has an open, tubular, flexible sleeve member which is expandable for receiving at least a portion of the main body of a flashlight, and for being releasably retained on the flashlight. The flexible sleeve member has a first open end and an opposed second open end. The carrier device also has a strap member having a first end and a second end with the first end of the strap member secured adjacent to the first open end of the flexible sleeve member and the second end of the strap member secured adjacent to the second open end of the flexible sleeve member. At least a portion of a hand of a person is receivable between the strap member and the flexible sleeve member releasably securing the sleeve device to the hand.

14 Claims, 3 Drawing Sheets

FLASHLIGHT CARRIER SLEEVE AND HANDLE

CROSS-REFERENCE TO RELATED APPLICATIONS

This application is a continuation-in-part of patent application Ser. No. 29/047,152 filed on Nov. 28, 1995, entitled "Flashlight Carrier Sleeve and Handle", and now U.S. Design Pat. No. 381,805, issued Aug. 5, 1997

BACKGROUND OF THE INVENTION

1. Field of the Invention

This invention relates generally to devices for carrying flashlights and, more particularly, it relates to devices for carrying flashlights which provide a soft, secure, comfortable gripping surface, and can always remain on the flashlight. More particularly, it relates to such a sleeve member which includes a hand strap which is secured to the sleeve member to provide a handle which allows a user to hold the flashlight with or without the use of the fingers; and a utility clip which allows the carrying device and flashlight to be secured to the clothing of the user or suspended at a convenient location for illumination or storage.

2. Description of the Prior Art

Flashlights commonly available on the market most often consist of a hard, durable tubular case containing and combining batteries and a light bulb. Typically being constructed of metal or hard plastic, the tubular cases are oftentimes uncomfortable for the user to grasp for extended periods of time especially in cold or other harsh weather environments. Furthermore, especially with larger and heavier flashlights, i.e., C-cell and D-cell type flashlights, the hand of the user which is used to grip the flashlight often becomes fatigued over an extended period of time, thereby requiring the user to either constantly switch the flashlight from one hand to the other, or to set the flashlight down in order to rest the hand holding the flashlight. Additionally, when holding a flashlight, typically only one hand of the user is available for completing the desired task since the other hand is required to hold the flashlight. As a result, the productivity of a user diminishes when holding a flashlight, thereby causing any task which requires the use of a flashlight to take a longer period of time to complete.

In the prior art, one example of a flashlight holder is described in Case, U.S. Pat. No. 5,053,932, issued to the Applicant of the present application. The Case patent describes a flashlight retainer that utilizes a headband having an elastic sleeve to accommodate flashlights of varying cross-sectional and dimensional characteristics. The flashlight holder of the Case patent is securable about the head of the user to allow a beam of illumination from the flashlight to be directed toward an object being observed by the user. Schweitzer U.S. Pat. No. 4,462,064 provides similar utility. However, these prior art flashlight holders do not provide any mechanism which would allow the user to use his or her hand to conveniently hold a flashlight.

Another example of a flashlight and flashlight holder is described in the Anderson, U.S. Pat. No. 5,188,450. The Anderson patent describes a flashlight assembly having a flashlight, a cushion grip, and a spare battery holder with the cushion grip and the spare battery holder comprising a single piece with two receptacles. The first receptacle retains the flashlight therein while the second receptacle retains at least one spare battery therein. The flashlight assembly of the Anderson patent further describes a hood which covers the end of the illumination end of the flashlight which typically houses the flashlight bulb and reflector. While providing a cushion grip for the hand of the user, the flashlight assembly of the Anderson patent neither inhibits fatigue of the hand of the user nor allows the flashlight user to utilize both hands without having to set or position the flashlight down out of his or her hand. The mere addition of the spare battery holder immediately adjacent the flashlight itself in the Anderson patent substantially increases the diameter of the hand gripping diameter of the combination, thereby increasing the fatigue of the hand of the user during extended use of the flashlight assembly. Furthermore, the flashlight assembly of the Anderson patent does not provide any mechanism which would allow the user to rest his or her hand or to use the hand which is holding the flashlight for a work project without requiring the user to set the flashlight assembly down Elsewhere in the prior art, U.S. Design Pat. Nos. 252,051 and 276,079 disclose lantern structures which have straps attached directly to the lanterns, not to a sleeve around the lantern. U.S. Design Pat. No. 344,411 discloses a wrist strap which includes a clamp for a flashlight. U.S. Pat. Nos. 5,180,352; 5,325,997 and 5,423,586 disclose gripping handles, some of which are attached to sleeves, for holding or carrying non-analogous items such as weights, protective sprays, or tanks, respectively.

SUMMARY OF THE INVENTION

It is therefore an object of the present invention to provide a combined flashlight carrier sleeve and handle which furnishes a soft, secure, comfortable gripping surface, and which can always remain on the flashlight.

It is another object of the present invention to provide a combined flashlight carrier sleeve and handle which avoids fatigue of the hand of the flashlight user, and which allows a user to hold the flashlight for extended periods of time without requiring the constant switching of the flashlight from one hand to the other hand, or setting the flashlight down in order to rest the hand.

It is yet a further object of the present invention to provide a combined flashlight carrier sleeve and handle which allows the user to hold a flashlight with or without the use of the fingers.

It is still a further object of the present invention to provide a flashlight carrier sleeve and handle which does not diminish the productivity of the user when using the flashlight during any desired task.

It is still yet further object of the present invention to provide a flashlight carrier sleeve and handle which includes a utility clip which allows the carrying sleeve and flashlight to be secured to the clothing of the user or suspended at a convenient location for storage or for illumination.

It is yet another object of the present invention to provide a flashlight carrier sleeve and handle, with or without a utility clip, which is designed to be an integral part of the flashlight, which does not have to be removed from the flashlight, but which rather can remain on the flashlight at all times, that is during hand held use, carrying, and storage of the flashlight.

The present invention is a flashlight carrier sleeve device for carrying a flashlight which has a main body and an illumination end. The sleeve device of the present invention comprises an open, tubular, flexible sleeve member which is expandable for receiving at least a portion of the main body of a flashlight, and for being releasably retained on the flashlight. The sleeve member provides a soft, secure, comfortable gripping surface which can always remain on the flashlight. The sleeve device further includes a strap member secured to the sleeve member which is designed to allow at least a portion of the hand or fingers of a person to be received between the strap member and the sleeve member thereby releasably securing the sleeve device to the hand.

In one preferred embodiment the sleeve device of the present invention comprises a first strap portion secured to the first end of the sleeve member and a second strap portion secured to the second end of the sleeve member. In this embodiment the sleeve device further includes an adjustment element for adjusting the length of the first or second strap member to adjust the length of the strap so that it may be, for example, tightened or loosened about the hand of a person holding the sleeve device and flashlight to releasably maintain the sleeve device to the hand of the person.

In yet another preferred embodiment the sleeve device of the present invention the strap member has a first and second opposed end, and has a pair of ends which are attached directly to the first and second opposed ends of the sleeve member. Preferably, this embodiment of the sleeve device comprises a single strap and is composed of elastic material.

In still another preferred embodiment, the sleeve device of the present invention includes a utility clip assembly secured to the sleeve device for releasably securing the sleeve device to the clothing of the user or suspended from an object at a convenient location for illumination or storage. Preferably, the utility clip assembly has a ring portion, and the utility clip assembly includes a swivel with the ring.

The present invention further includes a method for carrying a flashlight. In one preferred embodiment, the method of the present invention comprises the strap member having a first strap and a second strap, and having an adjustment element for adjusting the length of the first or second strap member to adjust the length of the strap so that it may be, for example, tightened or loosened about the hand of a person holding the sleeve device and flashlight to releasably maintain the sleeve device to the hand of the person. In another preferred embodiment, the method of the present invention comprises using an elastic strap member having a pair of opposed ends secured to the opposed ends of the sleeve member which allows at least a portion of a hand of a person to be inserted between the strap member and the sleeve member releasably attaching the sleeve device to a portion of the hand. In still yet another embodiment of the present invention, the method comprises providing a utility clip assembly is secured to the sleeve device for securing the sleeve device to an object.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENTS

Figure 1:
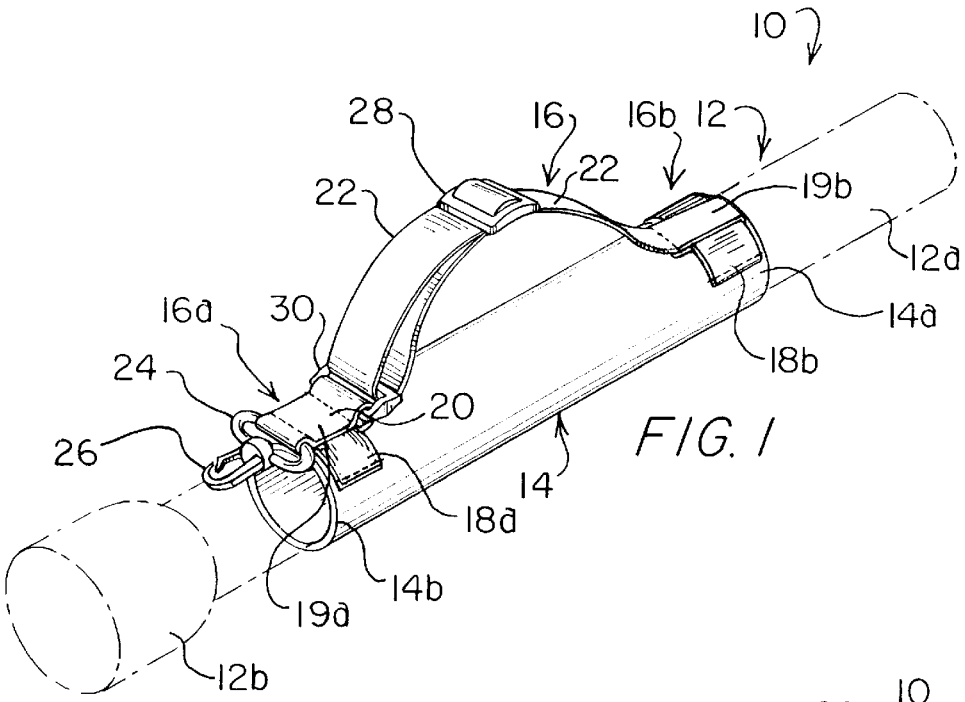
FIG. 1 is a front, top perspective view of the flashlight carrier sleeve and handle constructed in accordance with the present invention, the broken lines illustrating a flashlight in phantom for illustrative purposes.
Figure 2:
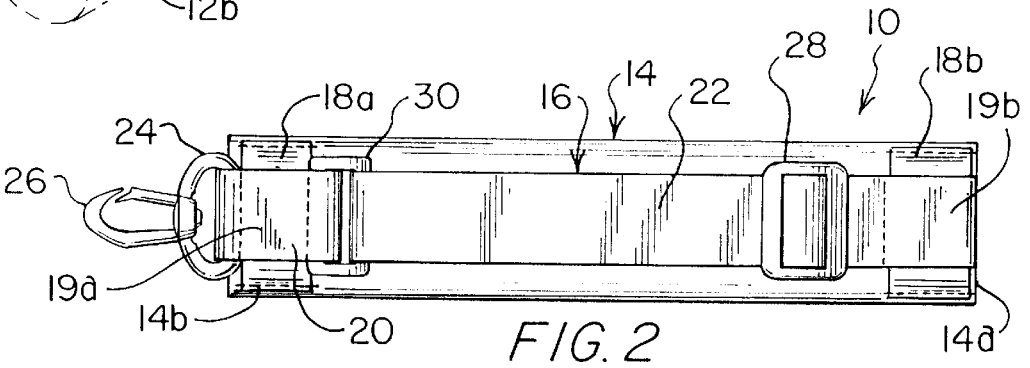
FIG. 2 is a top plan view of the flashlight carrier sleeve and handle illustrated in FIG. 1 and constructed in accordance with the present invention.
Figure 3:
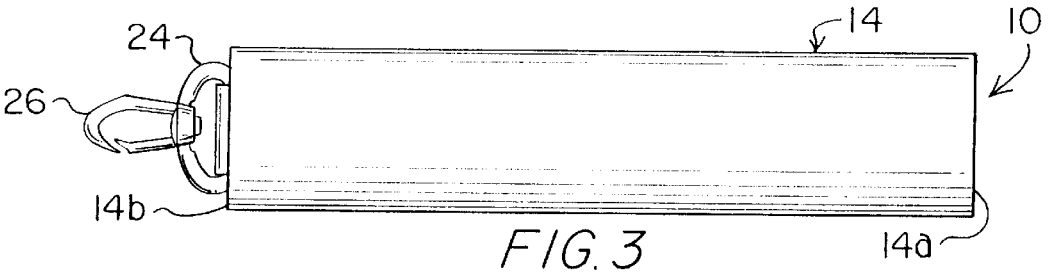
FIG. 3 is a bottom plan view of the flashlight carrier sleeve and handle illustrated in FIG. 1 and constructed in accordance with the present invention.
Figure 4:
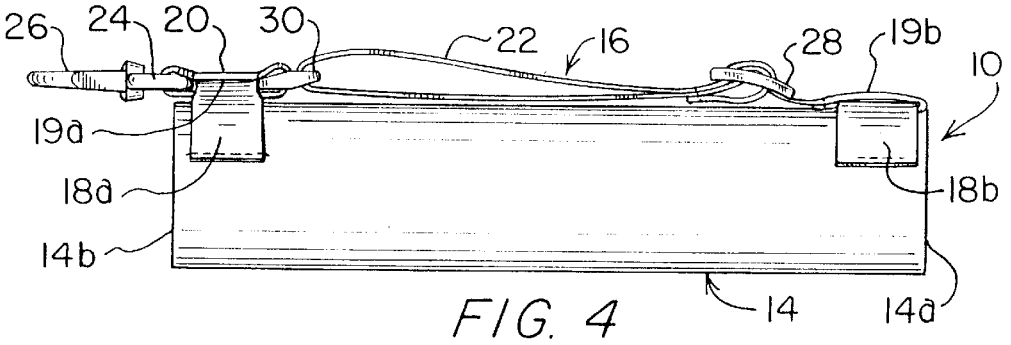
FIG. 4 is a left side elevational view flashlight carrier sleeve and handle illustrated in FIG. 1 and constructed in accordance with the present invention.
Figure 5:
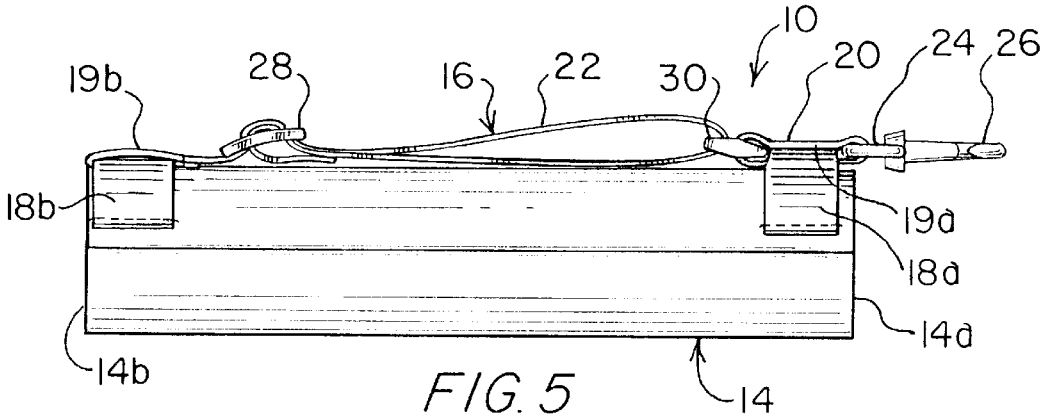
FIG. 5 is a right side elevational view of the flashlight carrier sleeve and handle illustrated in FIG. 1 and constructed in accordance with the present invention.

Referring now to the drawings, and first to FIGS. 1–10, in FIG. 1 a flashlight carrier sleeve and handle assembly in accordance with my invention is illustrated, generally as 10, installed on a flashlight 12. Flashlight 12, while not constituting a part of the present invention, has a main tubular body 12*a* and an illumination end 12*b*. The carrier sleeve 10 of the illustrated embodiment of the assembly of the present invention has an open, tubular, flexible sleeve portion 14 which is expandable for stretching over and around and receiving at least a portion of the main tubular body 12*a*, flashlight 12, and for being releasably retained on flashlight 12. Open tubular sleeve portion 14 is constructed of a molded or formed flexible elastic rubber, or synthetic rubber, or polymeric material. In preferred embodiments, for example, sleeve portion 14 is constructed of an elastic material such as Neoprene rubber or of a Lycra/Neoprene composite fabric, although other elastic materials can be used. The sleeve portion 14 provides a soft, secure, comfortable, cushioning, non-slipping, insulated surface, which elastically grips the tubular body 12*a* of flashlight 12, and which can always remain on flashlight 12. The sleeve portion 14 has a first open end 14*a* and an opposed second open end 14*b*.

A handle portion or strap member, generally 16, is attached to the sleeve portion 14. The handle portion 16 can be adjustable, as illustrated in FIGS. 1–10, and/or constructed from an elastic material, as illustrated in FIGS. 11–14, to be able to provide a releasable connection to the hand of a user.

The flashlight carrier sleeve and handle assembly 10 further comprises a handle or strap member, generally 16, having a first end generally 16*a* and an opposed second end generally 16*b*. The first end 16*a* of the strap member 16 is secured adjacent to the first open end 14*a* of the sleeve portion 14 and the second end 16*b* of the strap member 16 is secured adjacent to the opposed second open end 14*b* of the sleeve portion 14. At least a portion of the hand or fingers of a person is receivable between the strap member 16 and the sleeve portion 14, thereby releasably securing the flashlight carrier sleeve and handle assembly to the hand or fingers of a user. In the preferred embodiment of the present invention shown and illustrated in FIGS. 1–10, the flashlight carrier sleeve and handle assembly includes a pair of rectangular reinforcing patches 18*a* and 18*b* secured to the sleeve portion 14. Each reinforcing patch 18*a* and 18*b* has a pair of opposed ends, and is preferably elastic. The reinforcing patches 18*a* and 18*b* are preferably located circumferentially about the circumference of the sleeve portion 14, and are attached one adjacent to the first end 14*a* and one adjacent to the opposed second end 14*b*. Where the reinforcing patches 18*a* and 18*b* are sewed to the sleeve portion 14 the stitching is parallel rather than circumferential to the limited by transverse stitching. The first end 16*a* and opposed second end 16*b* of strap member 16 are secured to, and extendable between the respective reinforcing patches 18*a* and 18*b*. In preferred embodiments the first end 16*a* and opposed second end 16*b* of the strap member 16 are each formed into closed loops 19*a* and 19*b* encircling retaining patches 18*a* and 18*b*, respectively, which patches 18*a* and 18*b* are attached to the sleeve portion 14 at its opposed ends 14*a* and 14*b*, respectively. In preferred embodiments the securing and attaching of these elements is accomplished by sewing.

Figure 6:
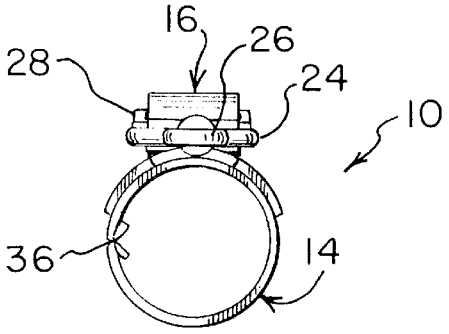
FIG. 6 is a front elevational view of the flashlight carrier sleeve and handle illustrated in FIG. 1 and constructed in accordance with the present invention.
Figure 7:
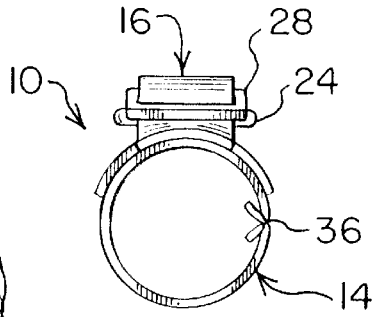
FIG. 7 is a rear elevational view of the flashlight carrier sleeve and handle illustrated in FIG. 1 and constructed in accordance with the present invention.
Figure 8:
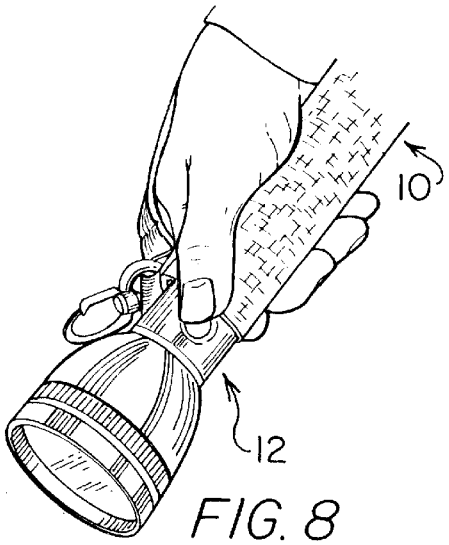
FIGS. 8 and 9 is an illustration of the embodiment of the flashlight carrier sleeve and handle constructed in accordance to FIG. 1 in the hand of a user and showing the handle over the back of the hand of the user, and with the thumb of the user at the switch of the flashlight, respectively.
Figure 9:
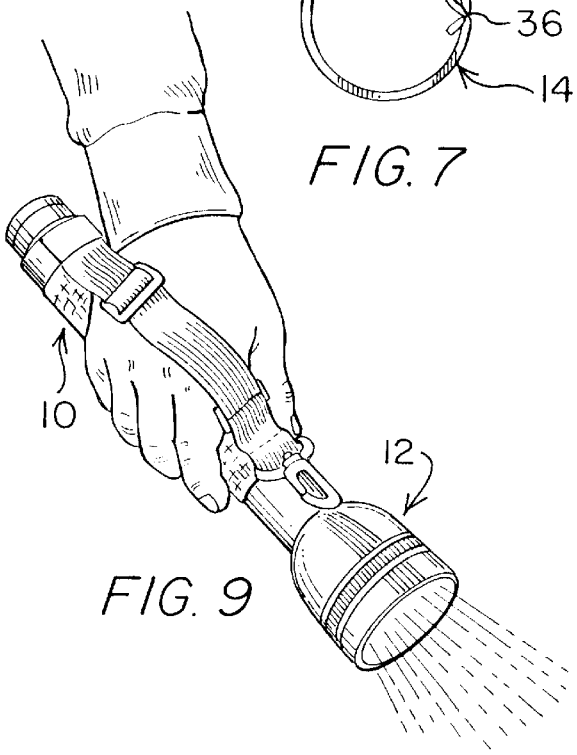

In the embodiment of the flashlight carrier sleeve and handle assembly of the present invention illustrated in FIGS. 1–10, handle portion 16 includes a first strap portion comprised of an elongated piece of flat, non-elastic webbing 20 and a second strap portion comprised of an elongated piece of flat, non-elastic webbing 22. The adjustment element may comprise, for example, a buckle mechanism having a webbing ring portion 30 and a slider portion 24, shown in the form of a ring with the webbing ring portion secured adjacent to the second end of both the first strap non-elastic webbing portion 20 and the slider portion 24 secured adjacent to the second end of the second strap non-elastic webbing portion 22. First strap non-elastic webbing portion 20 is secured to the first end 14*a* of the sleeve portion 14 and second strap non-elastic webbing portion 22 is secured to the second end 14*b* of the sleeve portion 14. In this embodiment the flashlight carrier sleeve and handle assembly 10 further includes an adjustment element for adjusting the length of the first or second strap member to adjust the length of the strap so that it may be, for example, tightened or loosened about the hand of a user holding the flashlight carrier sleeve and handle assembly, and flashlight to releasably maintain the flashlight carrier sleeve and handle assembly to the hand of the user, as shown in FIGS. 8 and 9.

As shown, first elongated webbing piece 20 carries a ring 24 having an integral utility clip 26. One end of the first webbing piece 20 is wrapped around ring 24 and connected to itself, for example by sewing, to fasten it to ring 24 and utility clip 26. The other end of first webbing piece 20 is threaded through separate rectangular ring 30 and connected to itself, for example also by sewing, to fasten it to ring 30. The first webbing piece 20 is connected to the first end 14*a* of sleeve portion 14 at reinforcing patch 18*b*, as described above. In preferred embodiments utility clip 26 is constructed in a manner which allows it to swivel within ring 24. One end of the second piece of webbing 22 is connected to the second end 14*b* of sleeve portion 14 at reinforcing patch 18*b*, as described above. The other end of the second piece of webbing 22 is threaded through separate rectangular ring 30 and thence through slider buckle 28. Slider buckle 28 has a cross bar. The other end of the second piece of webbing 22 is threaded around the cross bar of slider buckle 28 and connected to itself, for example also by sewing, to fasten it to slider buckle 28.

Figure 10:
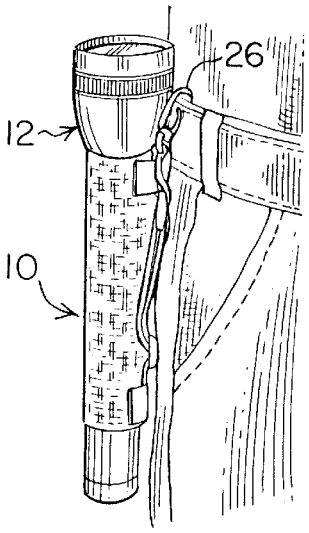
FIG. 10 is an illustration of the embodiment of the flashlight carrier sleeve and handle constructed in accordance to FIG. 1 clipped to the belt of the user.

The adjustable handle portion 16 can be shortened or lengthened by grasping the buckle 28 and frictionally sliding it along the second webbing piece 22. Preferably, the user grasps the flashlight 12 through the sleeve portion 14 with one hand in a manner such that the fingers or back of the hand are under the handle portion 16. The user then tightens the handle portion 16 against the hand or fingers by grasping the slider buckle 28 and sliding it 24 towards the rear of flashlight 12 with his/her other hand. In this manner, the flashlight carrier and handle 10 conveniently allows the user to securely grasp flashlight 12 and secure it to his or her hand, and when not using flashlight 12, to use utility clip 26 to connect the flashlight to the pant waist, or belt, as illustrated in FIG. 10, or any other portion of clothing or a carried pack or a variety of other places which are limited only by the imagination of the user. In addition, the handle portion 16 of the present invention permits the user to handle and manipulate other devices with the fingers of the hand that is holding the flashlight without releasing the flashlight.

Webbing 20 and 22, is preferably made of a non-elastic fabric material such as nylon, although it can also be constructed of a strap material such as leather, a flexible plastic, and other flexible materials, including elastic materials. A single elongated piece of elastic material can also be used, as illustrated in FIGS. 11–14.

The sleeve portion 14 is a preferably constructed from a rectangular piece of material which is folded over and two opposing edges sewn together in a stitched seam 36, as shown in FIGS. 6 and 7. The seam 36 can optionally be reinforced with a strip of fabric, not shown. The sleeve 14 is then turned inside out to hide the seam 36 on the inside of the sleeve portion 14.

Utility clip 26 can be plastic or metal and can be of any conventional design. For example, clip 26 is preferably a spring loaded snap hook, although a simple open hook may be used. The rectangular webbing ring 30 and slider buckle 28 can also be made of plastic or metal, although plastic is preferred for weight, cost, and corrosion resistance considerations.

The flashlight carrier sleeve and handle 10 of the present invention can be manufactured to accept and hold any size flashlight. This is simply accomplished by changing the diameter or length of the sleeve portion 14 so as to elastically accommodate the tubular body 12*a* of the particular size flashlight and provide a snug fit.

Figure 12:
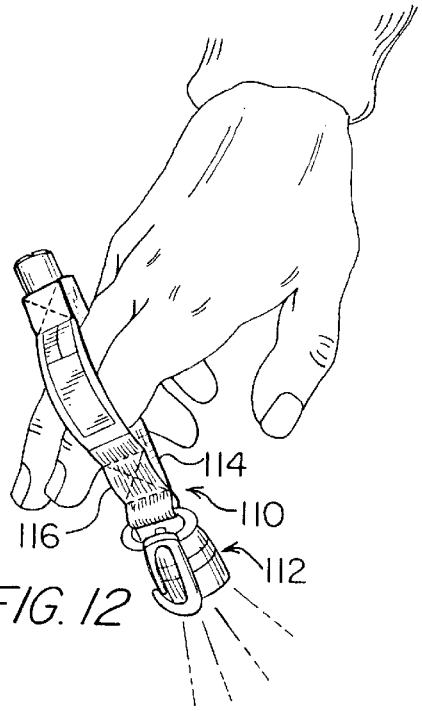
FIG. 12 is an illustration of the embodiment of the flashlight carrier sleeve and handle constructed in accordance to FIG. 11 on the fingers of a user.
Figure 11:
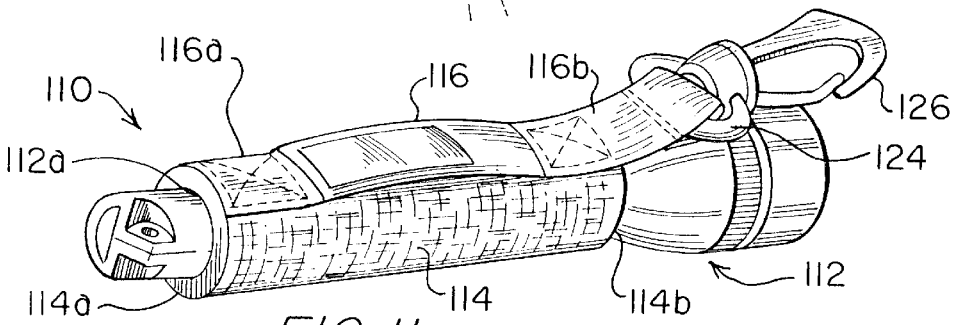
FIG. 11 is a perspective view of an alternative embodiment of the flashlight carrier sleeve with a one piece handle, and for use with a smaller flashlight, constructed in accordance with the present invention illustrated installed on a flashlight.

An alternative embodiment of the flashlight carrier sleave and handle assembly of the present invention, generally 110 is illustrated in FIGS. 11–14. FIG. 11 shows a perspective view of sleeve 114 with a one piece handle or strap member 116 installed on a flashlight 112. As with the first embodiment sleeve portion 114 is tubular and flexible and has a first and second opposed end 114*a* and 114*b*. The sleeve portion 114 comprises an open, tubular, flexible sleeve member which is expandable for receiving at least a portion of the main body of a flashlight 112*a,* and for being releasably retained on flashlight 112. This embodiment has utility for use with smaller flashlights, such as the popular AA flashlight MINI-MAGLITE® flashlight. In this embodiment the flashlight carrier sleeve and handle assembly 110 strap member 116 has a first end 116*a* and a second opposed end 116*b*. First end 116*a* and second opposed end 116*b* are attached directly to the first end 114*a* and second opposed end 114*b* of the sleeve portion 114, preferably by sewing. The second end of the strap 116*b* carries a ring 124 having an integral utility clip 126. Preferably, in this embodiment of the flashlight carrier sleeve and handle assembly 110 the one piece strap 116 is composed of elastic material. In this embodiment elastic one piece strap member 116 allows at least a portion of the hand or fingers of a person to be inserted between the strap member and the sleeve portion 114 releasably attaching the flashlight carrier sleeve and handle assembly 110 to a portion of the hand of a user, as illustrated in FIG. 12.

Figure 14:
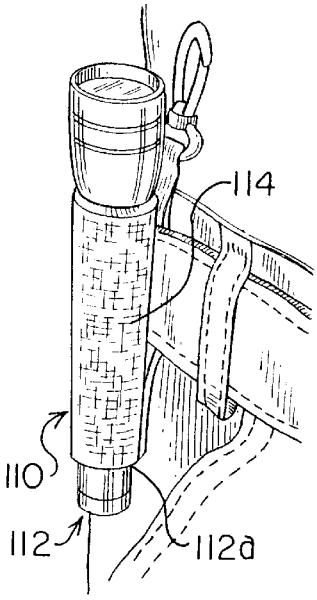
FIG. 14 is an illustration of the embodiment of the flashlight carrier sleeve and handle constructed in accordance to FIG. 11 on the belt of a user.
Figure 13:
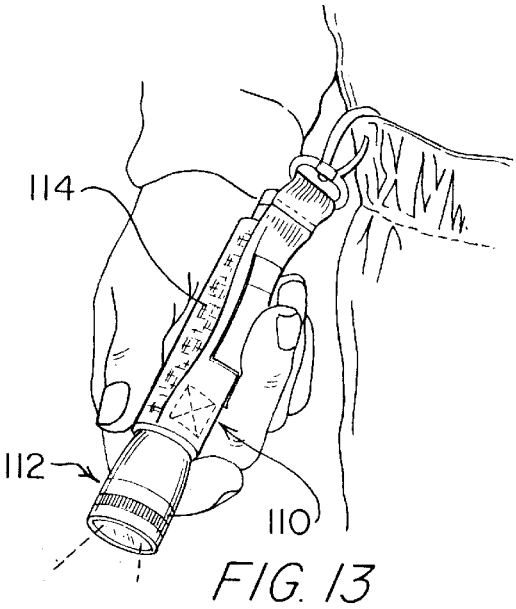
FIG. 13 is an illustration of the embodiment of the flashlight carrier sleeve and handle constructed in accordance to FIG. 11 clipped to the belt of a user, and being pivoted upwards in the hand of a user.
Figure 15:
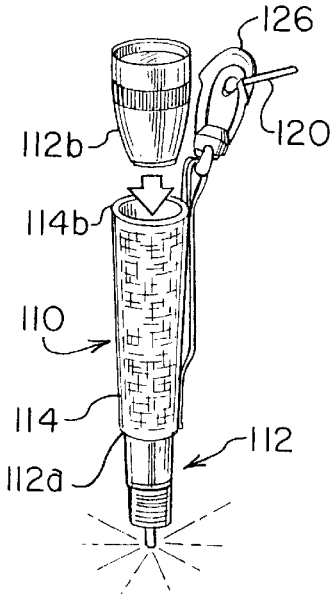
FIG. 15 is an illustration of the embodiment of the flashlight carrier sleeve and handle constructed in accordance to FIG. 11 positioned to be clipped to a structure, such as a nail, to suspend a flashlight configured to serve as a candle.

FIG. 13 is an illustration of the second embodiment of the flashlight carrier sleeve and handle constructed in accordance to FIG. 11 attached by utility clip 126 to the belt of a user, and being pivoted upwards in the hand of a user. FIG. 14 is an illustration of the second embodiment of the flashlight carrier sleeve and handle constructed in accordance to FIG. 11 on the belt of a user. FIG. 15 is an illustration of the second embodiment of the flashlight carrier sleeve and handle constructed in accordance to FIG. 11 positioned to be attached by utility clip 126 to a structure, such as a nail 120, to suspend a flashlight, such as the AA MINI-MAGLITE® flashlight 112 configured to serve as a candle. Note, the head 112*b* of the flashlight, which must be removed to provide the candle feature, can be stored in the first open end 114*a* of the carrier sleeve in order to avoid its being lost or damaged.

The present invention further includes the methods for carrying a flashlight using the flashlight carrier sleeve and handle device constructed in accordance to the present invention.

The flashlight carrier sleeve and handle 10 can be designed other than as specifically described and shown herein. For example, the webbing piece 20 can utilize a hook and loop type adjustable fastening system rather than the slider buckle 24. Alternatively, a series of snaps can be used on webbing 20 rather than the slider buckle 24, however, for ease of adjustment and use, slider buckle 24 is preferred. The reinforcing patches 18*a* and 18*b* can also alternatively be positioned on the underside surface of the sleeve portion 14, rather than outside the sleeve portion 14 as is shown in FIGS. 1–10. In a further alternative, the ends of straps 16 or 116 can be laid on top of the rear end of the sleeve portion 14 or 114, and reinforcing patches placed thereon and sewn to the top of the rear end of the sleeve portion.

It is thus seen that the present invention provides a combined flashlight carrier sleeve and handle which furnish a soft, secure, comfortable gripping surface, and which can always remain on the flashlight, thereby avoiding fatigue of the hand of the flashlight user, and which allows a user to hold the flashlight, with or without the use of the fingers for extended periods of time, thereby avoiding the need to switch the flashlight from one hand to the other hand, or set the flashlight down in order to rest the hand. In addition, the flashlight carrier sleeve and handle may increase the productivity of a person holding a flashlight during any desired manual task. When including a utility clip, the flashlight carrier sleeve and handle allows the carrying sleeve and flashlight to be secured to any object, including the clothing of the user, or to be suspended from any object, or at any convenient location for storage or for illumination. Moreover, the flashlight carrier sleeve and handle, with or without a utility clip, is designed to be an integral part of the flashlight, which does not have to be removed from the flashlight, but which rather can remain on the flashlight at all times, that is during hand held use, carrying, and storage of the flashlight.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A flashlight carrier sleeve device for carrying a flashlight having a main body and an illumination end, the device comprising:

an open tubular flexible sleeve member which is expandable for receiving at least a portion of the main body of a flashlight for releasably retaining the flashlight, said flexible sleeve member having a first open end and an opposed second open end; and a strap member having a first end and a second end, said first end of said strap member secured adjacent to said first open end of said flexible sleeve member and said second end of said strap member secured adjacent to said second open end of said flexible sleeve member, and so dimensioned that at least a portion of a hand of a person is receivable between said strap member and said flexible sleeve member, thereby releasably securing said flashlight carrier sleeve device to the hand.

2. The flashlight carrier sleeve device of claim 1 wherein first and second reinforcing patches are secured to said sleeve member, said first reinforcing patch being adjacent to said first open end of said flexible tube member, and said second reinforcing patch being adjacent to said second open end of said flexible tube member, said first end of said strap member being secured to said first reinforcing patch, and said second end of said strap member being secured to said second reinforcing patch.

3. The sleeve device of claim 2 wherein said first and second reinforcing patches are sewn to said first and second ends of said sleeve member, respectively, said first and second ends of said strap member being extendable between said first and second reinforcing patches, said first and second ends of said strap member each being formed into a loop about said first and second reinforcing patches, respectively.

4. The flashlight carrier sleeve device of claim 1 wherein said strap member has first and second ends and wherein said first and second ends of said strap member are sewn to said sleeve member by a stitched seam.

5. The flashlight carrier sleeve device of claim 1 wherein said strap member comprises a first strap portion having a first and second strap end, and a second strap portion having a first and second strap end, said first strap ends of both said first and second strap portions being secured to one of said opposed ends of said flexible sleeve member, and further comprising adjustment means secured to said second strap ends of said first and second strap portions for adjusting said strap member, whereby said strap member is adjustably tightenable about the hand of the person to releasably securely maintain said sleeve device to the hand of the person.

6. The sleeve device of claim 5 wherein said adjustment means comprises a buckle mechanism having a buckle portion and a slider portion, said buckle portion securable to said second end of said first strap portion and said slider portion securable to said second end of said second strap portion.

7. The sleeve device of claim 1 wherein said strap member comprises a single strap constructed from a flexible material.

8. The sleeve device of claim 1 and further comprising a clasp assembly securable to said strap member for releasably securing said sleeve device to an object in a substantially vertical position.

9. The sleeve device of claim 8 wherein said clasp assembly has a ring portion with said strap member extending through said ring portion and forming a loop encircling said ring portion.

10. The sleeve device of claim 8 wherein said clasp assembly includes a swivel mechanism.

11. A method for carrying a flashlight, the flashlight having a main body and an illumination end, the method comprising:

providing an open tubular flexible sleeve member expandable for receiving at least a portion of the main body of a flashlight;

inserting at least a portion of the main body of the flashlight into said flexible sleeve member, said flexible sleeve member releasably frictionally retaining at least a portion of the main body of a flashlightflashlight;

securing a strap member to said flexible sleeve member; and inserting at least a portion of a hand of a person between said strap member and said flexible sleeve member releasably securing said flexible sleeve member to the hand.

12. The method of claim 11 wherein said strap member comprises a first strap portion having a first and second strap end and a second strap portion having a first and second strap end and further comprising securing said first strap ends of said first and second strap portions to said sleeve member, and yet further comprising providing adjustment means secured to said second strap ends of said first and second straps for adjusting said strap member, and still further comprising adjusting said strap member about the hand of the person to releasably securely maintain said sleeve device to the hand of the person.

13. The method of claim 11 and further comprising providing a clasp assembly secured to said strap member for releasably securing said flexible sleeve member to an object.

14. A flashlight carrier sleeve device for carrying a flashlight, the flashlight having a main body and an illumination end, the device comprising:

an open tubular flexible sleeve member expandable for receiving at least a portion of the main body of a flashlight for releasably retaining a flashlight, said sleeve member having a first open end and an opposed second open end; and first and second reinforcing patches secured to said sleeve member, said first reinforcing patch being adjacent to said first open end of said flexible sleeve member, and said second reinforcing patch being adjacent to said second open end of said flexible sleeve member;

a strap member having a first end and a second end, said strap member extendable between said first reinforcing patch and said second reinforcing patch, said first end of said strap member formed into a loop about said first reinforcing patch adjacent to said first open end of said sleeve member with said first end of said strap member securable to a portion of said strap member adjacent to said first strap end, and said second end of said strap member formable into a loop about said second reinforcing patch adjacent to said second open end of said sleeve member with said second end of said strap member securable to a portion of said strap member adjacent to said second strap end, said strap member being so dimensioned that at least a portion of a hand of a person is receivable between said strap member and said sleeve member, thereby releasably securing said flashlight carrier sleeve device to the hand.

* * * * *